US007845425B2

(12) United States Patent
Flynn

(10) Patent No.: US 7,845,425 B2
(45) Date of Patent: Dec. 7, 2010

(54) FIRE SPRINKLER WITH CUTOFF VALVE, TAMPER-RESISTANT FEATURES AND STATUS INDICATOR

(76) Inventor: Matt Flynn, 7709 Sandy Bottom Way, Raleigh, NC (US) 27613

( * ) Notice: Subject to any disclaimer, the term of this patent is extended or adjusted under 35 U.S.C. 154(b) by 182 days.

(21) Appl. No.: 12/359,880

(22) Filed: Jan. 26, 2009

(65) Prior Publication Data

US 2010/0186973 A1 Jul. 29, 2010

(51) Int. Cl.
*A62C 39/00* (2006.01)

(52) U.S. Cl. ..... 169/90

(58) Field of Classification Search ..... 169/37, 169/90, 40, 41, 19, 33; 239/569, 580, 582.1
See application file for complete search history.

(56) References Cited

U.S. PATENT DOCUMENTS

| | | | | |
|---|---|---|---|---|
| 2,697,008 | A | 12/1954 | Rowley | |
| 3,757,866 | A * | 9/1973 | Mears et al. | 169/37 |
| 4,073,438 | A | 2/1978 | Meyer | |
| 4,638,866 | A | 1/1987 | Capasso et al. | |
| 4,676,320 | A * | 6/1987 | Capasso | 169/90 |
| 4,830,117 | A | 5/1989 | Capasso | |
| 4,923,013 | A | 5/1990 | De Gennaro | |
| 6,575,252 | B2 | 6/2003 | Reed | |
| 6,648,077 | B2 | 11/2003 | Hoffman | |
| 6,854,668 | B2 | 2/2005 | Wancho et al. | |
| 6,976,543 | B1 | 12/2005 | Fischer | |
| 7,275,604 | B1 | 10/2007 | Wall | |
| 7,422,072 | B2 | 9/2008 | Dade | |
| 2002/0139056 | A1 | 10/2002 | Finnell | |
| 2003/0010509 | A1 | 1/2003 | Hoffman | |
| 2007/0215362 | A1 * | 9/2007 | Rodgers | 169/46 |
| 2007/0221388 | A1 | 9/2007 | Johnson | |
| 2007/0267202 | A1 | 11/2007 | Mariller | |

* cited by examiner

*Primary Examiner*—Davis Hwu
(74) *Attorney, Agent, or Firm*—Todd L. Juneau

(57) ABSTRACT

The present invention relates to a fire sprinkler head that once activated can be shut off via a built-in cutoff valve without requiring the flow of fire retardant in the feeding pipe to be cut off.

14 Claims, 12 Drawing Sheets

FIRE SPRINKLER WITH CUTOFF VALVE, TAMPER-RESISTANT FEATURES AND STATUS INDICATOR

STATEMENT REGARDING FEDERALLY SPONSORED RESEARCH OR DEVELOPMENT

No federal government funds were used in researching or developing this invention.

CROSS REFERENCE TO RELATED APPLICATIONS

Not applicable.

NAMES OF PARTIES TO A JOINT RESEARCH AGREEMENT

Not applicable.

BACKGROUND

1. Field of the Invention

The present invention relates to a fire sprinkler head that once activated can be shut off via a built-in cutoff valve without requiring the flow of fire retardant in the feeding pipe to be cut off.

2. Background of the Invention

When commercial and residential fire sprinklers are activated by heat, fire retardant flows freely through the sprinkler. Usually that fire retardant is water. Once the fire or fire risk has been suppressed, continued water flow causes considerable damage. In many cases this water damage grossly exceeds the damage caused by fire. It would be beneficial for firefighters and building support personnel to be able to shut off an individual fire sprinkler quickly. The current primary method for cutting off the water flow is to shut the water off at the source for the sprinkler system. This is time-consuming, as finding the riser room and then the correct shutoff valve can take many minutes. It is also dangerous, as the entire sprinkler system or subsystem is disabled until the fire sprinkler is repaired or replaced and water pressure is reestablished.

Capasso et al. U.S. Pat. No. 4,638,866 discloses an apparatus for stopping the flow of water through the opening in a fire sprinkler head after the failure of an originally installed triggering device, which apparatus thereafter serves as a substitute triggering device. The apparatus is provided with a meltable body portion having a first bore formed therein with a shoulder formed at one end of the first bore and a second bore formed generally transverse to and in contact with the first bore at the shoulder end of the first bore, a spring positioned in the first bore, a piston positioned within the spring and having a slot at one end which is alignable with the second bore and a pin inserted through the second bore and engaging the piston slot. Thus, after placement in a sprinkler head, transverse movement of the pin results in the release of the piston which is moved by the spring into the sprinkler head opening, stopping the flow of water.

Capasso, U.S. Pat. No. 4,830,117 discloses a thermally responsive device for terminating the discharge of fire-extinguishing fluid from an activated sprinkler head of the pendent and sidewall type. The device includes a recessed seat which, when impressed onto an activated sprinkler head, returns the shut-off valve to the water emitting conduit to obturate fluid flow. The device is secured by a frictional locking means which allows it to remain in place as a guard against inadvertent discharge.

DeGennaro, U.S. Pat. No. 4,923,013 discloses an automatic shut-off valve arrangement for a fire sprinkler system includes a set of auxiliary pipe fittings interconnected between the water distribution pipes and the sprinkler heads. Each fitting houses a multi-vane paddle wheel rotatably mounted under an eccentric valve opening normally unobstructed by a movable valve member, and the paddle wheel axle is connected by a gear train to an actuator for the valve member. When water flows from the distribution pipe through the fitting and exits therefrom via the sprinkler head to douse a fire, the paddle wheel rotates rapidly and drives the actuator via the gear train so that the valve member is shifted to close the valve opening and interrupt the flow of water therethrough after a prescribed time interval, thereby minimizing the risk of water damage to the protected premises.

Reed, U.S. Pat. No. 6,575,252 discloses a tool for deactivating a sprinkler head. The tool includes a housing, a first arm supported by the housing and a second arm supported for movement relative to the first arm. A first engagement surface is supported by the first arm and a second engagement surface is supported by the second arm. The first and second engagement surfaces are adapted for positioning intermediate a valve and a receiving support of the sprinkler head. A biasing member is operably connected to the second arm for urging the second engagement surface away from the first engagement surface. A handle is supported by the second arm and is moveable relative to the housing.

Wancho et al., U.S. Pat. No. 6,854,668 discloses a sprinkler that discharges a column of water downwardly onto a deflector that has a plurality of peripheral tines with a respective non-radial tapered notch separating each adjacent pair of tines. Opposed cutouts with tabs in the central portion of the deflector combine with the notches and with depressed peripheral tabs to produce a predetermined spray pattern.

Fischer, U.S. Pat. No. 6,976,543 discloses a low pressure, extended coverage, fire protection sprinkler, i.e. of the upright type, suitable for use in protection of extra hazard and high piled storage occupancies, in accordance with the 1999 Edition of NFPA 13, that has a body with an internal passageway extending between an inlet end and an opposite outlet end, and a deflector mounted to the body by at least one support arm and disposed in alignment with the axis and generally spaced from the outlet end of the internal passageway. The sprinkler has a predetermined K-factor, i.e. of greater than about 16.0. The sprinkler is configured and arranged to deflect flow of water generally radially outwardly and downwardly of the sprinkler in a predetermined spray pattern. Preferably, the predetermined spray pattern has a generally polygonal shape, e.g., a rectangular shape, when viewed at a predetermined distance below the deflector.

Dade, U.S. Pat. No. 7,422,072 discloses a sprinkler wedge designed for inhibiting water discharge from an open or activated sprinkler head. The sprinkler wedge generally comprises a main body having proximal and distal ends, a handle assembly connected toward the proximal end for easy grasping by a human hand, and a forked tip toward the distal end. The sprinkler wedge is designed for improved single-handed insertion into the water stream of an activated sprinkler head.

BRIEF SUMMARY OF THE INVENTION

The present invention builds a reusable cutoff valve into a fire sprinkler head. Once the sprinkler activates and the fire is suppressed, the cutoff valve can be used to completely and reliably shut off water flow. Leakage and closure failure are eliminated. Further, the water in the supply pipe does not have to be cut off. Other fire sprinkler heads are not affected, and the rest of the fire suppression system is not disabled. This is particularly important for densely populated living spaces such as dormitories and hotels, where loss of life can be considerable if a second fire breaks out while the system is down.

Embodiments of the present invention may include one or more of the following features.

In a preferred embodiment, there is provided a fire sprinkler with a built-in cutoff valve, comprising: a sprinkler housing having an externally threaded sprinkler nozzle disposed along a central axis, said externally threaded sprinkler nozzle having an activation plug disposed therein, said activation plug held in place by a heat-sensitive rod disposed along the central axis, said externally threaded sprinkler nozzle having a distal end for connecting to a supply pipe and a proximal end connected to a pair of support arms, each support arm extending from the proximal end of the threaded sprinkler nozzle and terminating at a support annulus that is disposed along the central axis, said support annulus circumferentially attached to a deflector shield and said support annulus connected to a proximal end of an internally-threaded shroud, said shroud having a recessed opening at a distal end and a screw-valve disposed therein along the central axis, said screw-valve having a screw-head at a distal end and a cone plug at a proximal end, wherein the cone plug is moveable along the central axis from an open position to a closed position by turning the screw-valve and engaging the internal threads of the shroud, wherein at the open position that cone plug is disposed within the support annulus and the heat-sensitive rod is seated thereon to hold the activation plug in place within the externally threaded sprinkler nozzle, and wherein at a closed position the cone plug seals the proximal end of the externally threaded sprinkler nozzle and the heat-sensitive rod and the activation plug are ejected.

In another preferred embodiment, there is provided a fire sprinkler as described herein, further including one or more of the following features alone, or in combinations.

A preferred embodiment where the externally threaded sprinkler nozzle is fitted for standard fire sprinkler fitting sizes.

A preferred embodiment where the sprinkler contains a wrench fitting to allow easier connection and disconnection from a sprinkler supply.

A preferred embodiment where the sprinkler contains a standard sealed fire sprinkler activation plug that stops the flow of the fire retardant from the sprinkler supply pipe through the sprinkler.

A preferred embodiment where the heat-sensitive rod is a frangible support rod that (1) holds the plug in place, (2) is thermodynamically responsive to at least one of heat, smoke, infrared radiation and ultraviolet radiation emitted by a heat source, and (3) deforms or dissolves when heated to its tolerance temperature.

A preferred embodiment where the deflector shield disperses water or other fire retardant in a reasonably uniform shower pattern to create more effective fire suppression.

A preferred embodiment wherein the sprinkler is installed as a pendent sprinkler below the supply pipe.

A preferred embodiment wherein the sprinkler is installed as a vertical sprinkler above the supply pipe.

A preferred embodiment where the cone plug forms a water-tight or gas-tight seal against sprinkler supply pipe pressure.

A preferred embodiment where the screw valve has a screw head with a flat-head or Phillips-head access.

A preferred embodiment where the screw valve has a custom tamper-proof screw head access and is not accessible by flat-head, Phillips-head, Allen wrench, hex wrench, or pliers.

A preferred embodiment where the shroud is made from impact-resistant material and has a flared end to facilitate guided access to the screw head by a valve closure tool.

A preferred embodiment wherein the screw head is painted to facilitate ready identification of closed sprinklers, wherein when the valve is closed and the screw head recessed, the presence or absence of paint can easily be seen.

A preferred embodiment where the paint on the screw head is fluorescent and reflective red.

BRIEF DESCRIPTION OF THE DRAWINGS

FIG. 9*a-d* are line drawings of various views of the sprinkler housing—nozzle, arms, ring. Non-limiting engineering measurements are provided. FIG. 9(*b*) is a top view of the nozzle. FIG. 9(*c*) is a top view of the support annulus. FIG. 9(*d*) shows three views: an elevational view of the housing, a cross-sectional side view of the housing, and a close-up detailed view of a cross-section of the support arms and annular ring.

FIG. 10 shows cross-sectional line A<=>A.

FIG. 11 shows from top to bottom, the cone plug (here a frusto-conical shape), the screw shaft, and the screw head.

FIG. 13(*a*) shows the shroud in cross-section, and identifies the location of thread for the cone plug. FIG. 13(*b*) shows both the top view along the central axis and the side view of the shroud.

DETAILED DESCRIPTION OF THE DRAWINGS

This invention incorporates a cutoff valve into a fire sprinkler head. When a fire sprinkler activates, releasing water, a screwed valve can be turned to close off the flow of water without affecting the function of other fire sprinklers and without shutting off water flow to the rest of the sprinkler system. Advantages of the present invention include that it is easy to open and close the secondary valve cutoff with one hand, and that the sprinkler cutoff valve can be reopened right away if the fire flares again. One does not need to go to the riser room or do anything other than unscrew the valve.

The cutoff valve is built into the sprinkler head. It is a screw-type valve. On activation of the sprinkler, the screw-valve can be screwed closed to reliably stop the flow of water. The sprinkler can then be rearmed and is reusable. The device has a narrow sheath that protects the valve screw from impact and tampering. This protective sheath has a flared opening to help guide the tool used to close and open the valve into the sheath to the screw head. The head of the screw valve is recessed in the sheath. The screw head can have a simple slot or cross arrangement, requiring a flat-head or Phillips-head screwdriver to turn, or a more tamper-resistant fitting requiring a mated tool made for that purpose.

A portion of the screw-valve mechanism is painted fluorescent reflective red or another readily visible color that is easily seen and will reflect a flashlight beam. When the valve is closed to deactivate the fire sprinkler, the indicator paint becomes visible, making deactivated fire sprinklers easy to identify.

Figure 1:
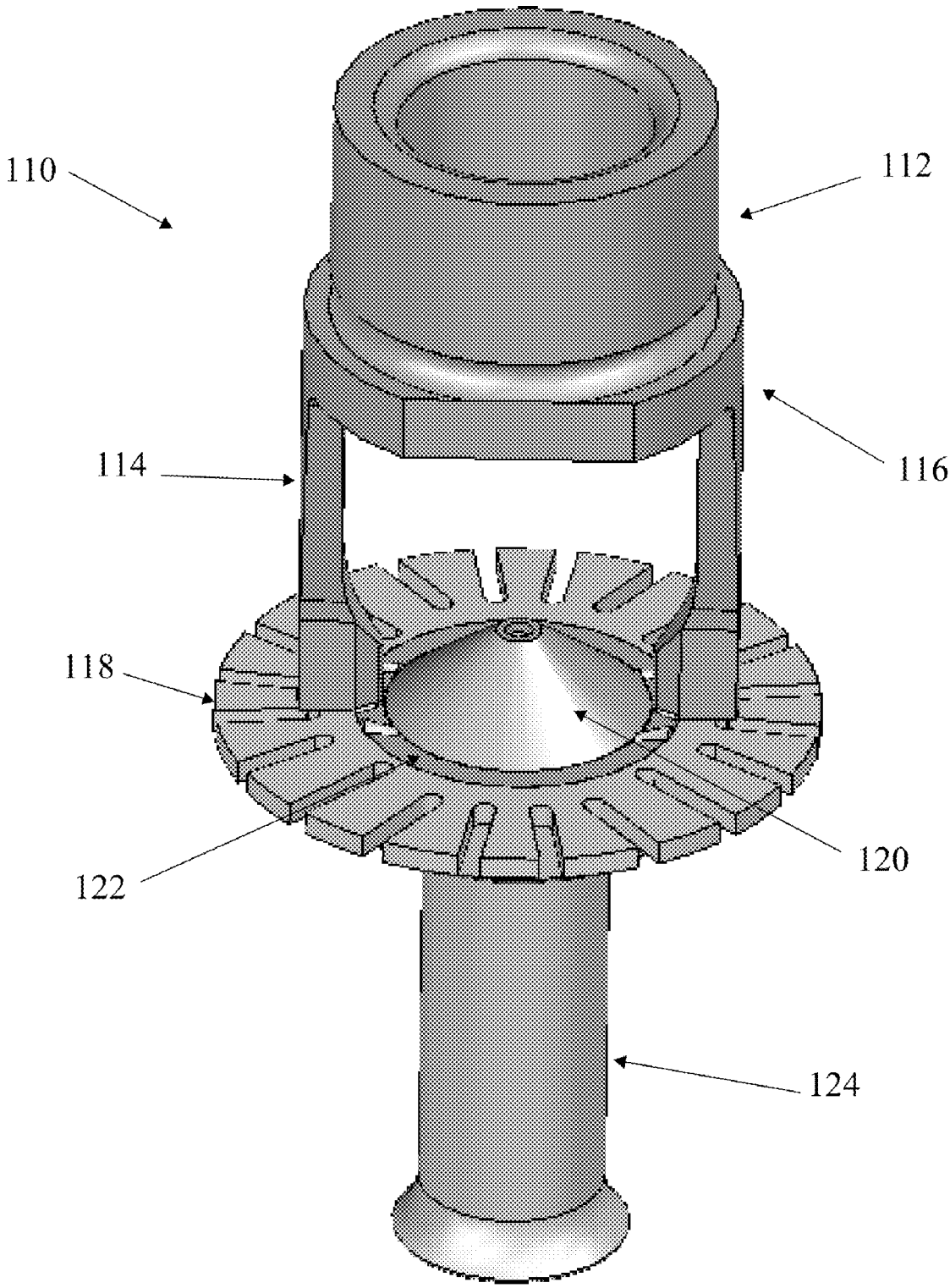
FIG. 1 is a graphical representation of one embodiment of the fire sprinkler head design from a front elevational view.

Referring now to the invention, certain features or options are discussed below. They are summarized as follows:

1. Open port for flow of fire retardant from a supply pipe into the sprinkler head. This can be made in a variety of sizes depending on the flow needs of the sprinkler system.
2. Screw fitting for screwing the fire sprinkler head into the sprinkler pipe. These screw fittings come in several standardized sizes depending on flow requirements. They can easily be made any size.
3. Inferior to the screw fitting of #2 are thin flat plates that allow use of a wrench to install or remove the sprinkler head. They can be made for any size wrench large enough to fit around the flow port.
4. The distal aperture of the fire retardant port in the sprinkler head. This aperture is sealed closed by a plug held in place by a heat sensitive rod. A wide range of plug sizes can be used to adapt to the intended flow volume of the fire sprinkler.
5. Plug to seal off fire retardant flow prior to activation. These plugs are sized to fit the port. The size used depends on the flow requirements of the sprinkler system.
6. A thermodynamically responsive frangible rod responsive to at least one of heat, smoke, infrared radiation and ultraviolet radiation emitted by a heat source. It holds the plug labeled #5 in place prior to activation. It deforms or dissolves when heated beyond its tolerance temperature, which can vary with different fire sprinkler types and uses. Once it deforms or dissolves, the plug is pushed out by pressure in the sprinkler pipe. Fire retardant then flows. These rods are not reusable.
7. The bracing point for the heat-sensing rod.
8. Housing for the sprinkler that provides support for the deflector and the bracing point for the heat-sensing rod.
9. The bracing point for the heat-sensitive rod that holds the heat-sensing rod in place prior to activation. In FIG. 1 this bracing point also connects the housing to the deflector. Other fire sprinkler heads connect the deflector to the housing directly. Both methods have similar effects.
10. The deflector. This deflects the flow of fire retardant to provide relatively even spraying over the area covered by the sprinkler head. The total area covered depends on the deflector used and the rate of flow of fire retardant through the activated sprinkler.

In other aspects, it is contemplated that the device may have an optional tamper-resistant closure mechanism and, optionally, a colored position indicator. Also, since the ability to shut off the flow of fire retardant is local, this does not require disabling other fire sprinklers or the water supply to the general sprinkler system. Further, an impact-resistant sheath built around the valve closure screw to protect the screw is contemplated.

FIG. 1 shows the sprinkler housing 110, externally threaded nozzle (at top, threads not visible) 112, support arms 114, support annulus 116, deflector shield 118, the dual-purpose sealing plug 120 for cutting off flow/seating for the heat-sensitive rod (not shown) that holds the original sealed plug in place prior to activation, i.e. the conical plug, seated within the annular ring 122 and extending down through the interior of the shroud 124, and the protective shroud. Note that the screw and the conical secondary sealing plug may be constructed as separate pieces.

Nozzle

Common threading (not shown) on the nozzle provides attachment means to ordinary pipes for supplying fire retardant, such as water.

Housing

The housing is modified to provide support for the built-in cutoff valve. The surface area plate must traverse the distance to the open port unimpeded. The modified housing does not taper to the bracing point for the sensing rod. Instead, the taper is greatly reduced or eliminated to allow the surface area plate to traverse to the open port without impediment. Further, the modified housing provides greater structural support to accommodate the torque involved in closing and opening the cutoff valve, to hold the protective sheath labeled in place, and to preserve the function of the deflector.

Connection

The connection of the housing to the deflector. The connection does not impair proper deflection and dispersal of fire retardant.

Deflector.

The deflector helps disperse fire retardant evenly over the sprinkler's area of effect.

Indentation in the surface area plate.

This indentation provides a seating point to brace the heat-sensitive rod in place.

Cutoff Valve Plug.

Once the sprinkler is activated, the heat-sensitive rod deforms or dissolves, and the sealed plug is released. Water or other fire retardant flows freely through the opening. On turning the cutoff valve, the cutoff valve plug travels towards the opening, seats into it, and stops the flow of water.

Space to Rearm the Sprinkler.

The space indicated shows that the cutoff valve has sufficient play to allow a new primary sprinkler plug and heat-sensitive rod to be inserted to rearm the sprinkler.

Base Plate

The base of the cutoff valve plug where the cutoff valve screw seats into the cutoff valve plug has a hard surface area plate. This plate provides a hard surface for the screw to push against and prevents the screw from penetrating the cutoff valve plug.

External Threads.

This metal ring is attached to the sprinkler housing or the deflector plate opposite the water pipe. It is coarsely threaded on the outside. This coarse threading is used to attach a cylindrical metal sheath that protects the cutoff valve screw and screw head.

Internal Threads.

The cutoff valve screw is threaded through these internal coarse threads to provide support for opening and closing the cutoff valve.

Cutoff Valve Screw.

This is a coarse-threaded screw tapped through the sprinkler housing opposite the sprinkler pipe that seats into the internal threads. On clockwise rotation, it pushes the cutoff valve plug across the sprinkler housing and into the open water/fire retardant port created by sprinkler activation. This screw can be painted a readily visible color, such as reflective red. When the cutoff valve is closed, sealing off water flow, the cutoff valve screw becomes easily visible to persons standing to the side of the sprinkler. The bright coloring makes it simple to identify an inactivated sprinkler.

Cutoff Valve Screw Head.

This is a hard circular plate at the end of the cutoff valve screw opposite the water pipe.

Seating for the Cutoff Valve Tool.

This can take a variety of forms. If tamper-resistance is not needed, a simple crossed slot arrangement can be used such that the cutoff valve can be opened or closed with a flat-head or Phillips-head screwdriver. When tamper-resistance is beneficial, such as in a dormitory setting, different seatings are used. In the example, metal protuberances in the shape of an hourglass extend from the surface of the cutoff valve screw head. An interlocking tool mates with the hourglass-shaped protuberances to allow the application of sufficient torque to close and open the cutoff valve. The hourglass seating makes it difficult to operate the valve with standard screwdrivers, pliers, and wrenches including Allen wrenches.

Protective Sheath.

This sheath is a cylinder that surrounds the cutoff valve screw when the cutoff valve is in the open position. One end is threaded. This end screws onto the external threads. The protective sheath is long enough that even in the fully open position, the cutoff valve screw is slightly recessed into it.

Flared End of Protective Sheath.

The outward flaring of the protective sheath acts as a guide for insertion of the appropriate tool to operate the cutoff valve.

Figure 2:
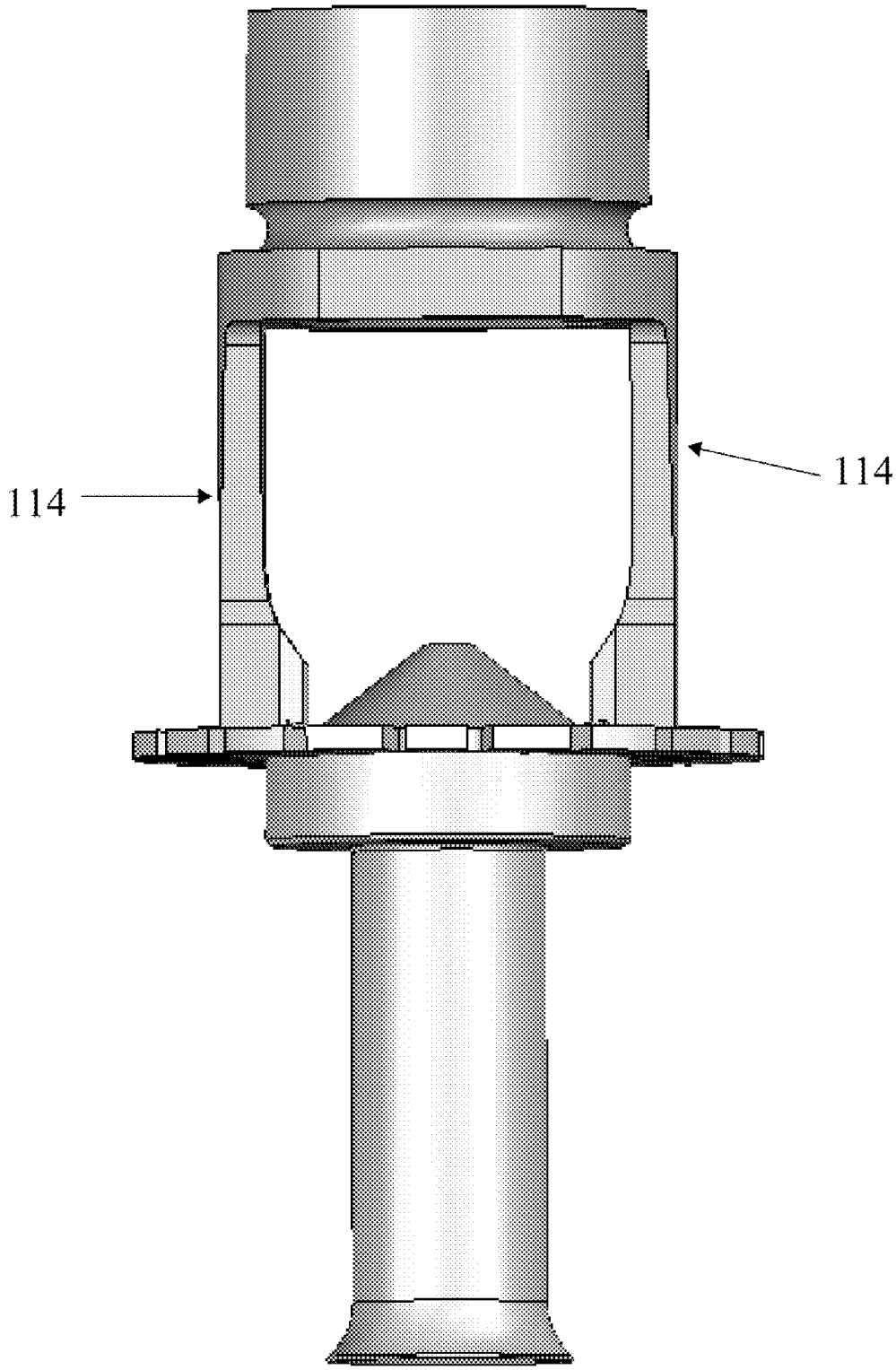
FIG. 2 is a graphical representation of one embodiment of the fire sprinkler from a front view.

Referring now to FIG. 2, FIG. 2 is a graphical representation of one embodiment of the fire sprinkler from a side view, and shows especially the features of the support arms 114.

Figure 3:
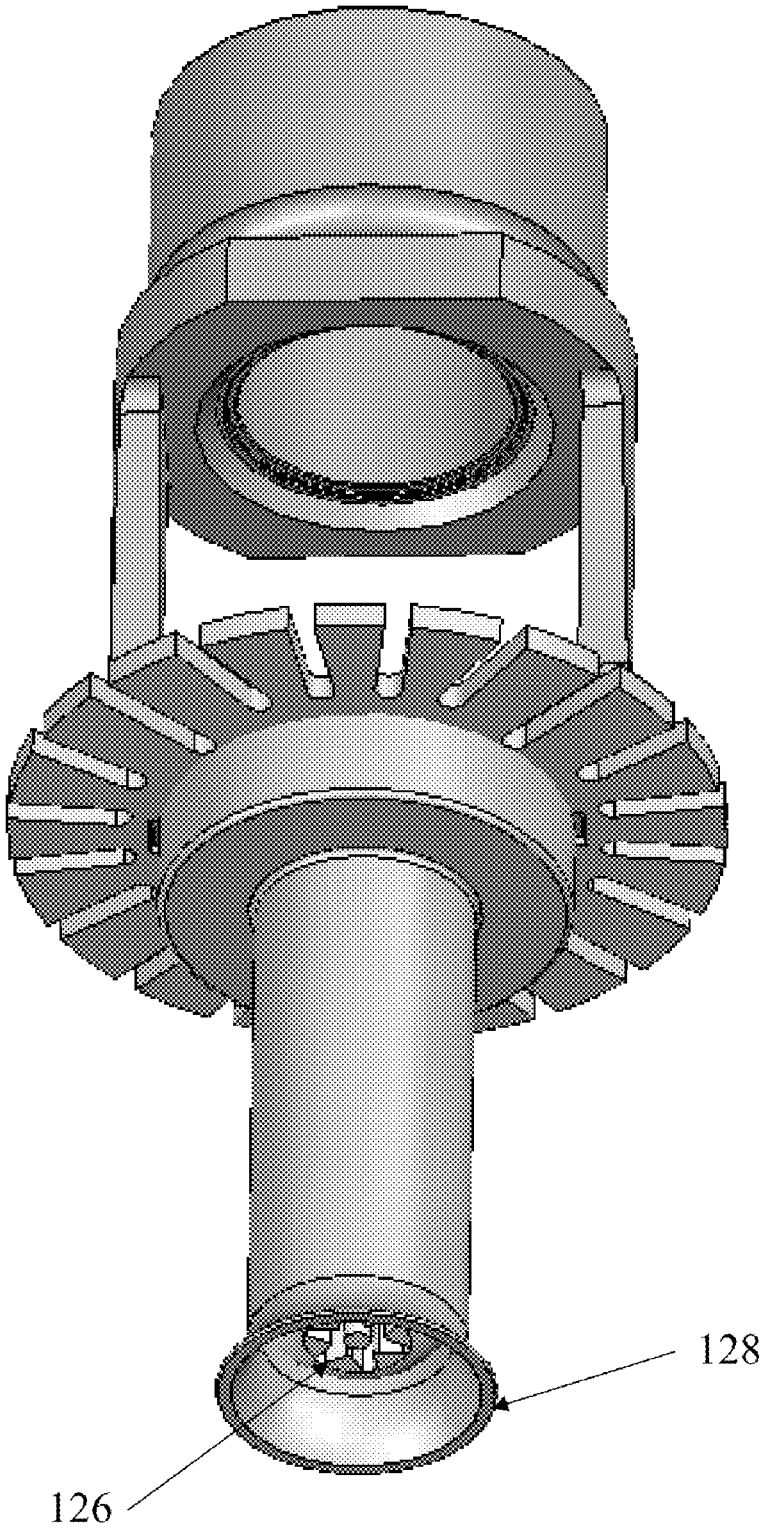
FIG. 3 is a graphical representation of one embodiment of the fire sprinkler from a front perspective view, from below.

FIG. 3 is a graphical representation of one embodiment of the fire sprinkler from a front view lower to upper. FIG. 3 shows the screw head 126 detail and a flared embodiment 128 of the shroud. FIG. 3 shows especially how the screw head 126 can be accessed from below.

Figure 4:
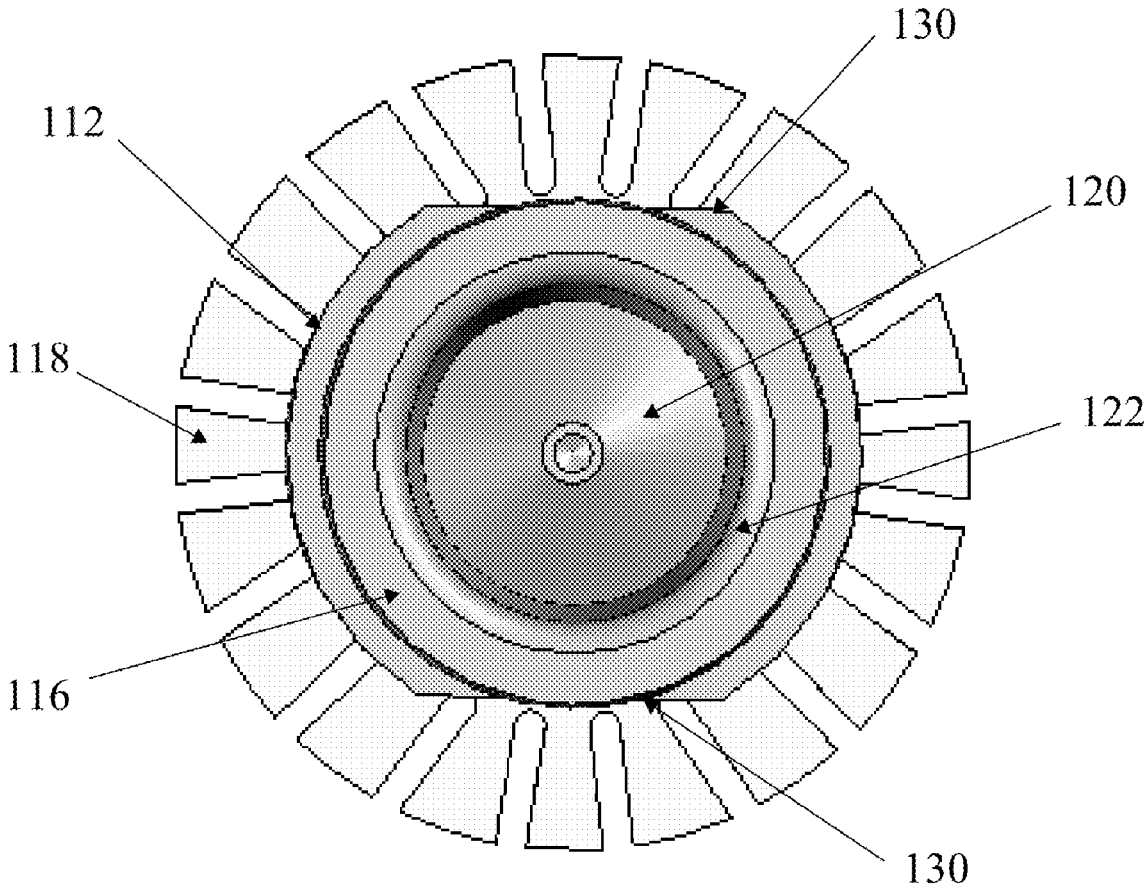
FIG. 4 is a graphical representation of one embodiment of the fire sprinkler from a top view down the central axis.

FIG. 4 is a graphical representation of one embodiment of the fire sprinkler from a top view down the central axis. FIG. 4 shows the nozzle 112, the deflector shield 118, the annulus 116, and the conical plug 120 within the annular support ring 122. FIG. 4 shows especially how the device has planar surfaces 130 (here top and bottom) which assists in the installation of the device into a pipe socket.

Figure 5:
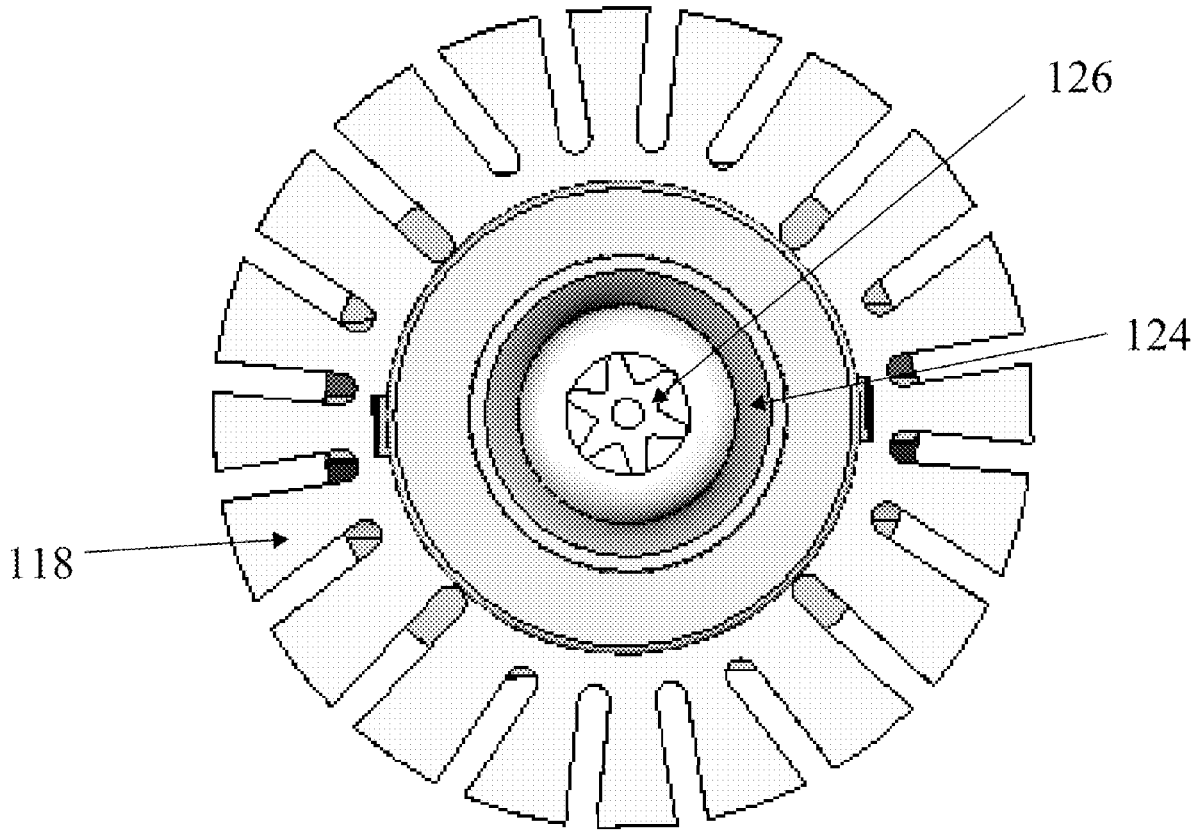
FIG. 5 is a graphical representation of one embodiment of the fire sprinkler from a bottom view up the central axis.

FIG. 5 is a graphical representation of one embodiment of the fire sprinkler from a bottom view up the central axis. FIG. 5 shows the screw head 126 disposed within the shroud 124, and the deflector shield 118 as seen from below. FIG. 5 shows how the screw head can be a custom tool, but also that it can be a Philips, flat-head, hex-nut, allen-wrench, etc.

Figure 6:
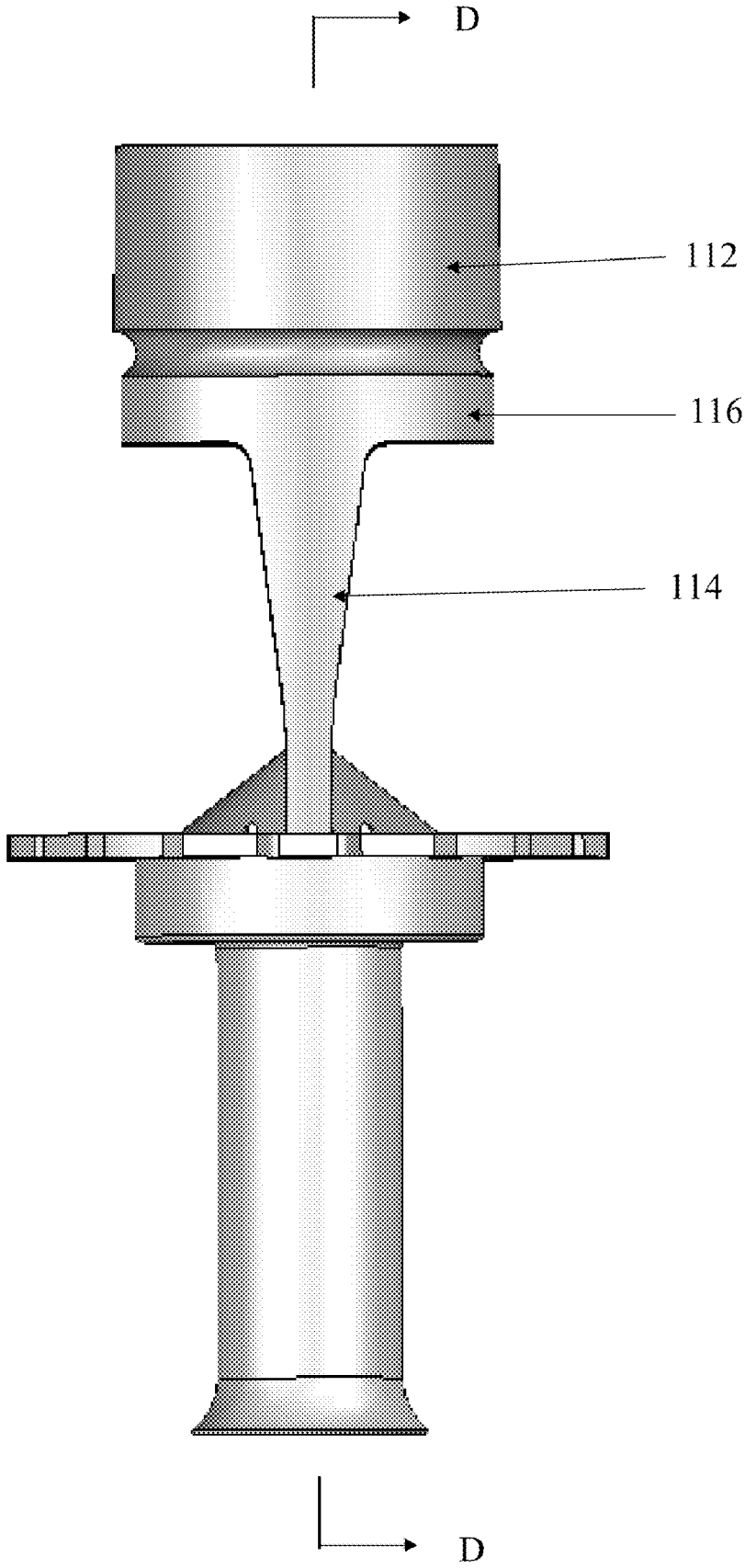
FIG. 6 is a graphical representation of one embodiment of the fire sprinkler from a side view that is 90 degrees (perpendicular) to FIG. 2.
Figure 7:
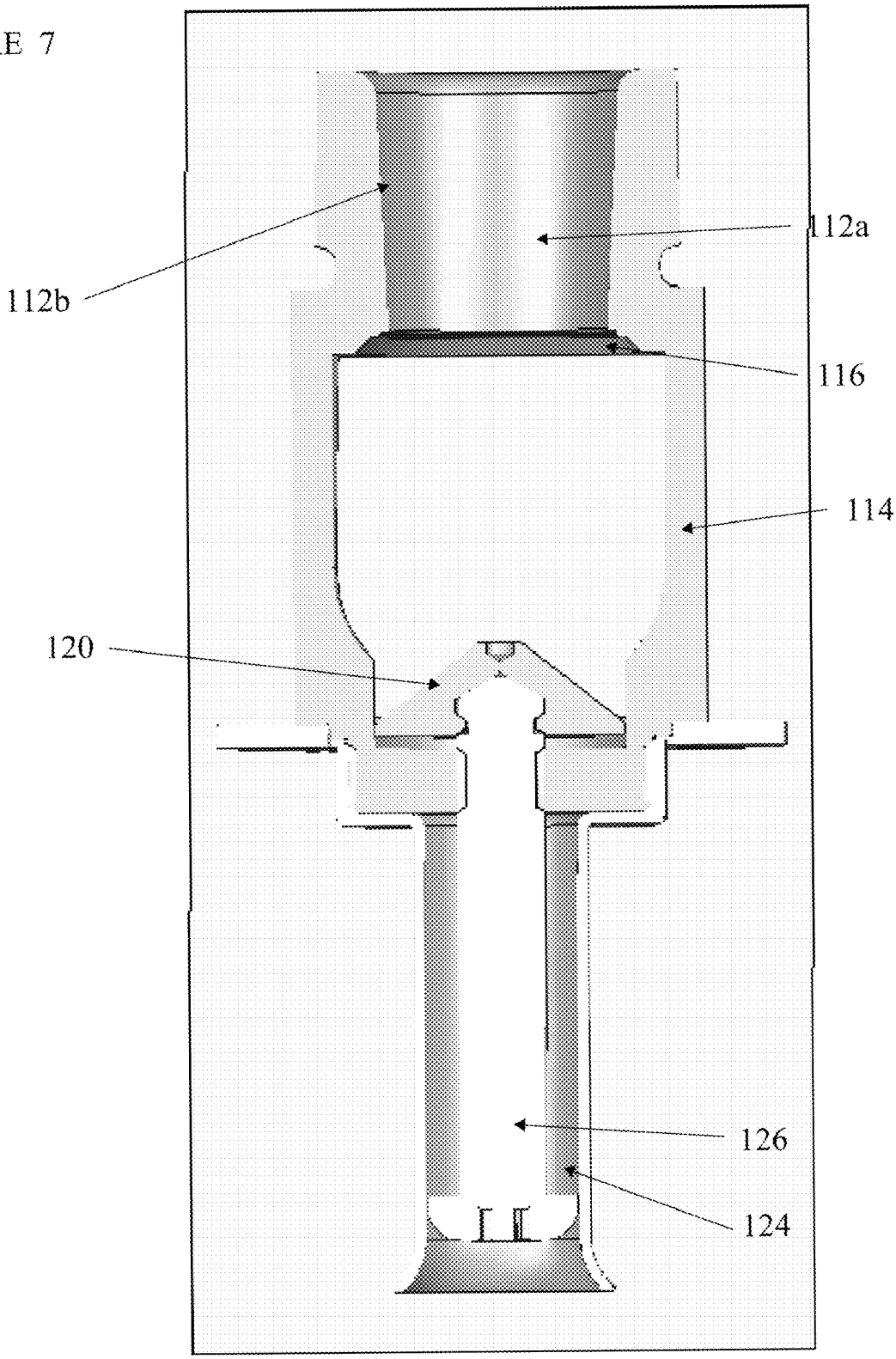
FIG. 7 is graphical representation of one embodiment of the fire sprinkler from a cross-sectional view, along line D<=>D.

FIG. 6 is a graphical representation of one embodiment of the fire sprinkler from a side view that is 90 degrees (perpendicular) to FIG. 2. FIG. 6 shows how the nozzle 112, support arm 116, and support annulus 116 may be constructed as a unitary part. FIG. 7 is graphical representation of one embodiment of the fire sprinkler from a cross-sectional view. FIG. 6 shows line D <=>D as the cross-sectional line for FIG. 7.

FIG. 7 shows the nozzle 112 having an inner 112*a* and outer 112*b* aspect, the support arms 114 attached to the support annulus 116, the screw valve unit 126 disposed with the shroud 124, the cone plug 120 at the top of the screw valve unit and the screw head at the bottom of the screw valve unit. FIG. 7 shows how an upward pressure will move the screw valve through the shroud, thus placing the cone plug into position to stop the flow of fire retardant from the nozzle.

Figure 8:
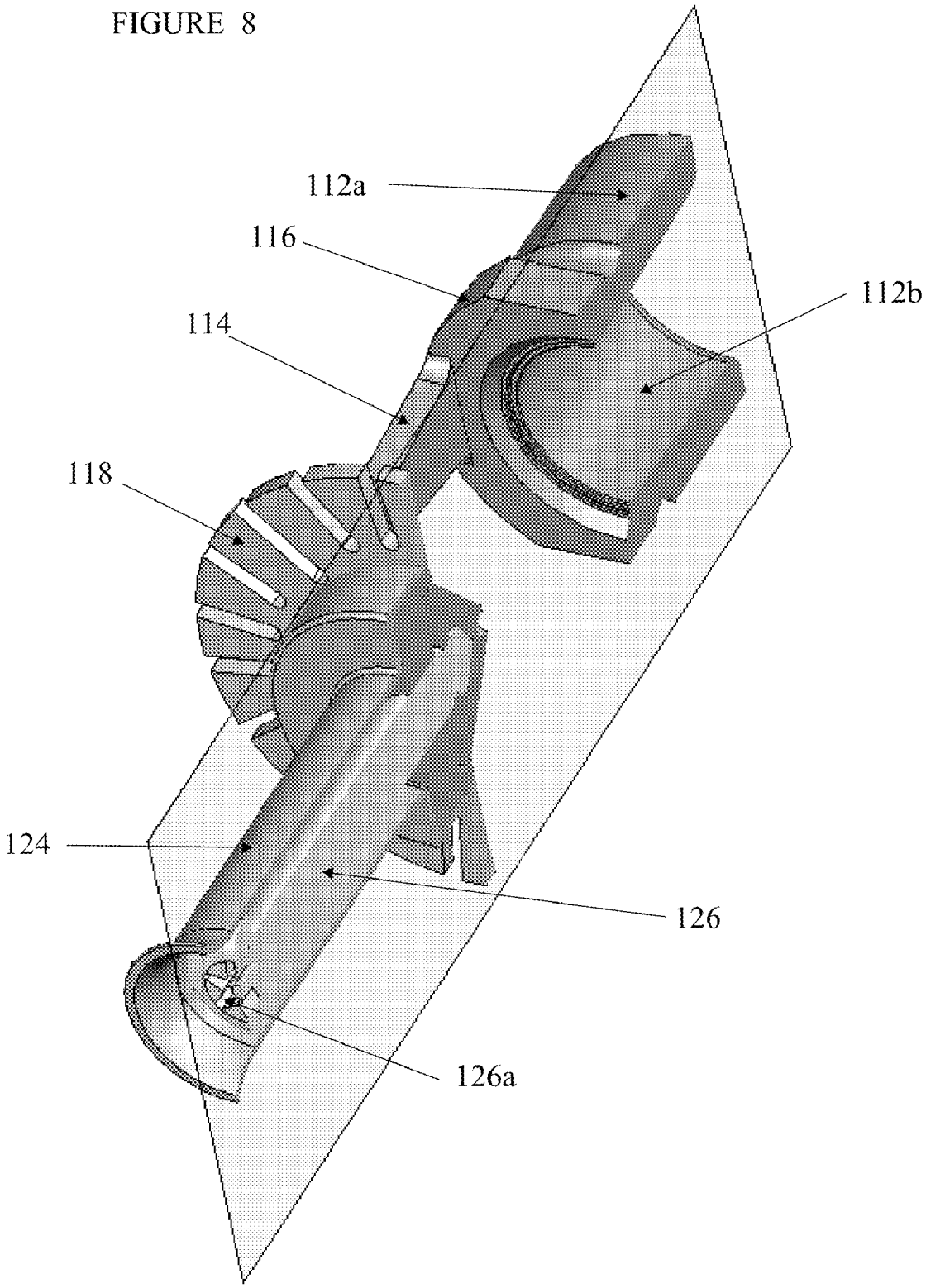
FIG. 8 is graphical representation of one embodiment of the fire sprinkler from a cross-sectional perspective view, that is 90 degrees (perpendicular) to FIG. 7.

FIG. 8 is graphical representation of one embodiment of the fire sprinkler from a cross-sectional perspective view. FIG. 8 shows the nozzle having an inner and outer aspect 112*a* 112*b*, a support arm 114 (only one is shown in this cross-section) attached to the support annulus 116, the deflector shield 118, the screw valve unit 126 disposed with the shroud 124, the cone plug 120 at the top of the screw valve unit and the screw head 126*a* at the bottom of the screw valve unit.

Figure 9A:
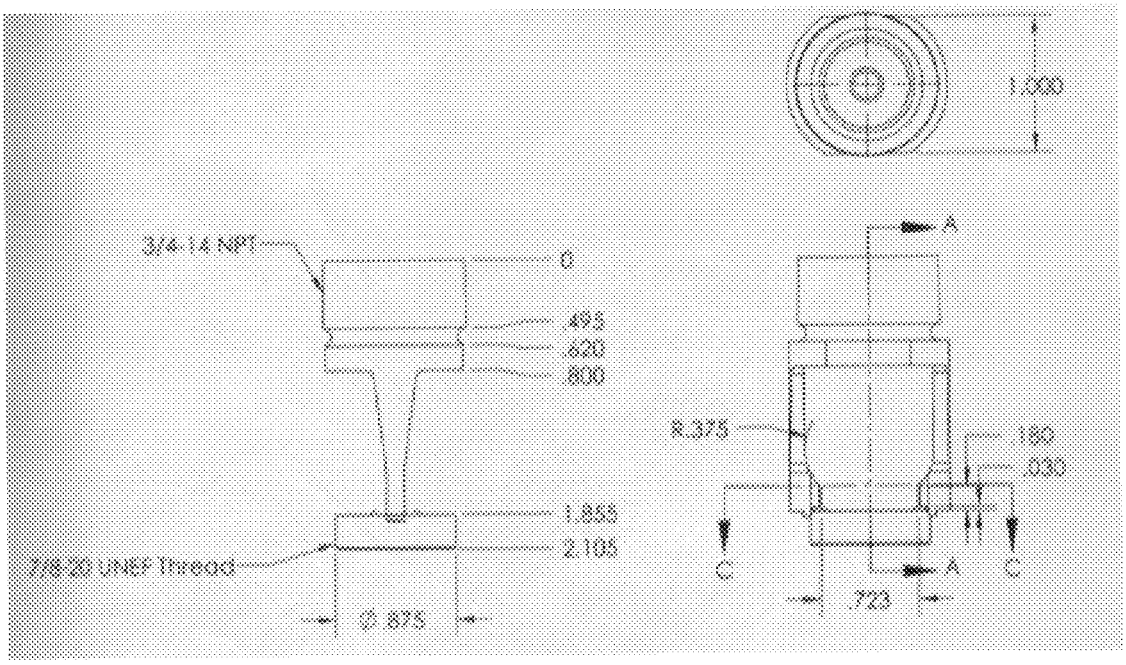
Figure 9B:
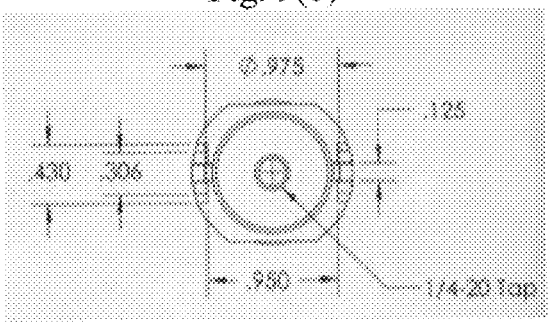
Figure 9:
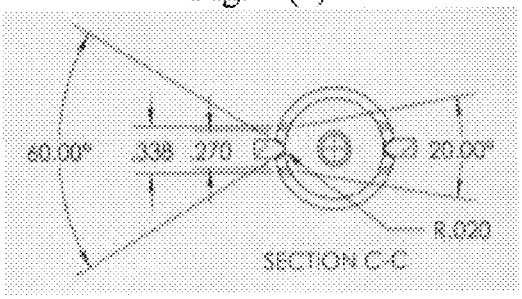
FIG. 9(*a*) show two side views and a top view, and also provides cross-sectional lines for A<=>A and C<=>C sections.
Figure 9D:
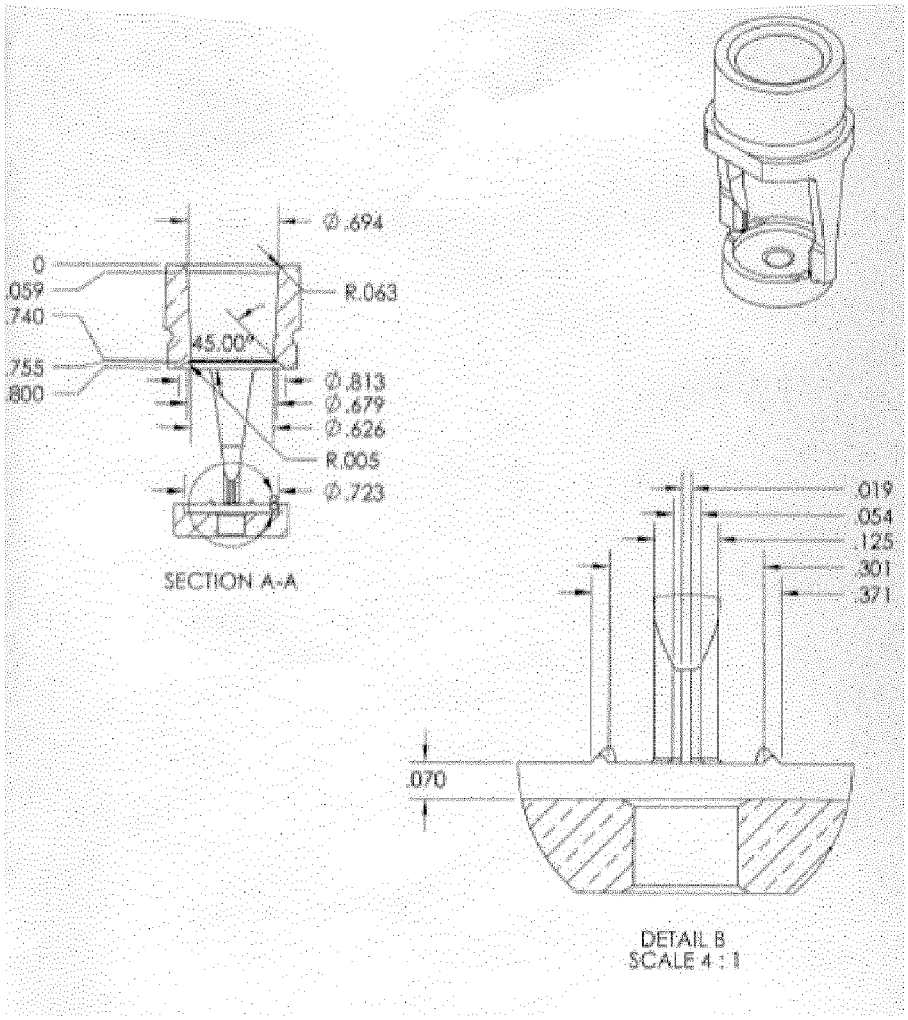

FIG. 9*a-d* are line drawings of various views of the sprinkler housing—nozzle, arms, ring. Non-limiting engineering measurements are provided. FIG. 9(*a*) show two side views and a top view, and also provides cross-sectional lines for A<=>A and C<=>C sections. FIG. 9(*b*) is a top view of the nozzle. FIG. 9(*c*) is a top view of the support annulus. FIG. 9(*d*) shows three views: an elevational view of the housing, a cross-sectional side view of the housing, and a close-up detailed view of a cross-section of the support arms and annular ring.

Figure 10:
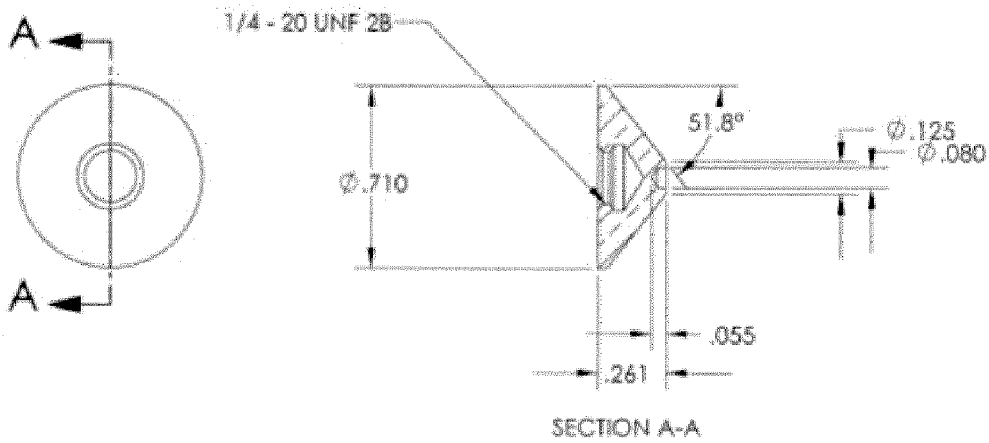
FIG. 10 is a line drawing of a top view of the cone plug, and a cross-sectional drawing of the cone plug.

FIG. 10 is a line drawing of a top view of the cone plug, and a cross-sectional drawing of the cone plug. FIG. 10 shows cross-sectional line A<=>A.

Figure 11:
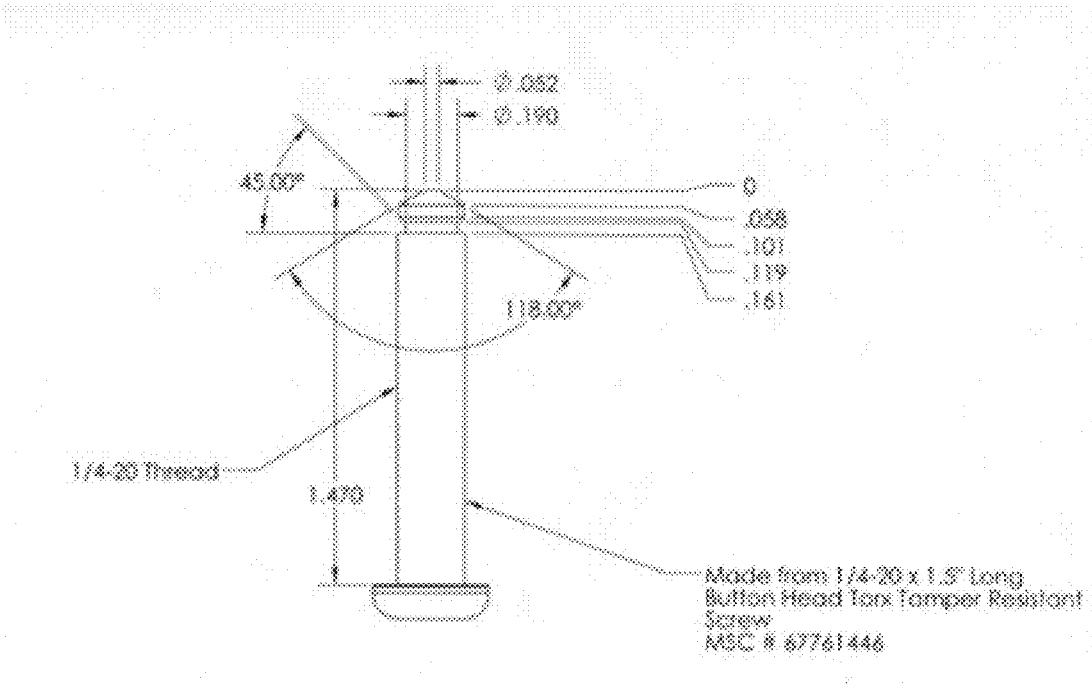
FIG. 11 is a line drawing of the screw valve.

FIG. 11 is a line drawing of the screw valve. FIG. 11 shows from top to bottom, the cone plug (here a frusto-conical shape), the screw shaft, and the screw head.

Figure 12:
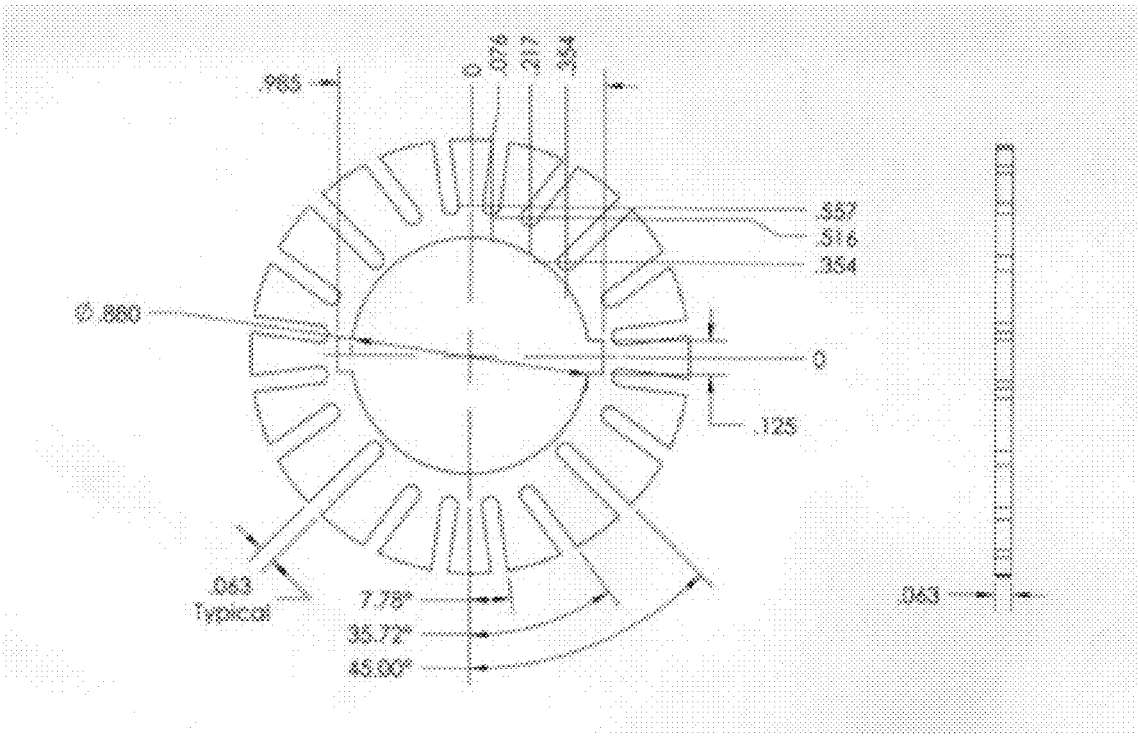
FIG. 12 is a line drawing of an embodiment of the deflector shield, from the top view and from the side view.

FIG. 12 is a line drawing of an embodiment of the deflector shield, from the top view and from the side view.

Figure 13A:
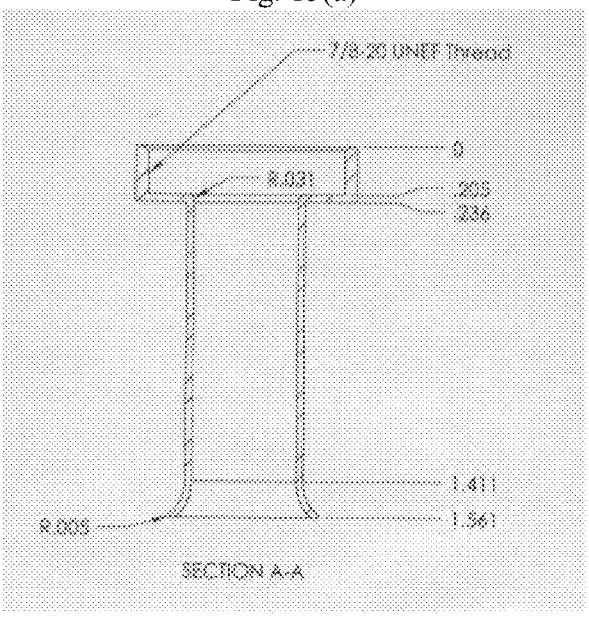
FIG. 13 is a set of line drawings of one embodiment of the shroud.
Figure 13B:
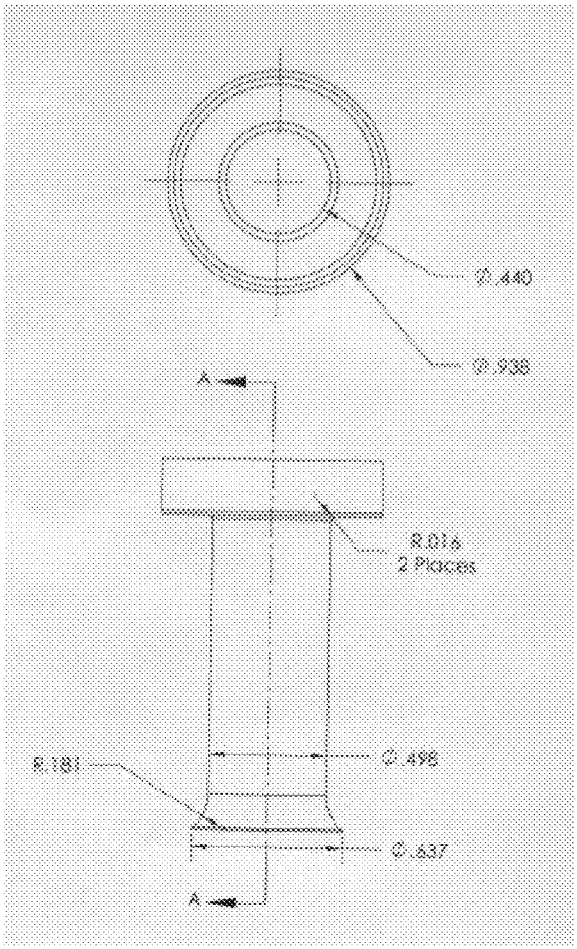

FIG. 13 is a set of line drawings of one embodiment of the shroud. FIG. 13(*a*) shows the shroud in cross-section, and identifies the location of thread for the cone plug. FIG. 13(*b*) shows both the top view along the central axis and the side view of the shroud.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims.

What is claimed is:

1. A fire sprinkler with a built-in cutoff valve, comprising: a sprinkler housing having an externally threaded sprinkler nozzle disposed along a central axis, said externally threaded sprinkler nozzle having an activation plug disposed therein, said activation plug attached to a heat-sensitive rod disposed along the central axis, said externally threaded sprinkler nozzle having a distal end for connecting to a supply pipe and a proximal end connected to a pair of support arms, each support arm extending from the proximal end of the threaded sprinkler nozzle and terminating at a support annulus that is disposed along the central axis, said support annulus circumferentially attached to a deflector shield and said support annulus connected to a proximal end of an internally-threaded shroud, said shroud having a recessed opening at a distal end and a screw-valve disposed therein along the central axis, said screw-valve having a screw-head at a distal end and a cone plug at a proximal end, wherein the cone plug is moveable along the central axis from an open position to a closed position by turning the screw-valve and engaging the internal threads of the shroud, wherein at the open position that cone plug is disposed within the support annulus and the heat-sensitive rod is seated thereon to hold the activation plug in place within the externally threaded sprinkler nozzle, and wherein at a closed position the cone plug seals the proximal end of the externally threaded sprinkler nozzle and the heat-sensitive rod and the activation plug are ejected.

2. The fire sprinkler of claim 1, where the externally threaded sprinkler nozzle is fitted for standard fire sprinkler fitting sizes.

3. The fire sprinkler of claim 1, where the sprinkler contains a wrench fitting to allow easier connection and disconnection from a sprinkler supply.

4. The fire sprinkler of claim 1, where the sprinkler contains a standard sealed fire sprinkler activation plug that stops the flow of the fire retardant from the sprinkler supply pipe through the sprinkler.

5. The fire sprinkler of claim 1, where the heat-sensitive rod is a frangible support rod that (1) holds the plug in place, (2) is thermodynamically responsive to at least one of heat, smoke, infrared radiation and ultraviolet radiation emitted by a heat source, and (3) deforms or dissolves when heated to its tolerance temperature.

6. The fire sprinkler of claim 1, where the deflector shield disperses water or other fire retardant in a reasonably uniform shower pattern to create more effective fire suppression.

7. The fire sprinkler of claim 1, wherein the sprinkler is installed as a pendent sprinkler below the supply pipe.

8. The fire sprinkler of claim 1, wherein the sprinkler is installed as a vertical sprinkler above the supply pipe, or as a lateral sprinkler.

9. The fire sprinkler of claim 1, where the cone plug forms water-tight or gas-tight seal against sprinkler supply pipe pressure.

10. The fire sprinkler of claim 1, where the screw valve has a screw head with a flat-head or Phillips-head access.

11. The fire sprinkler of claim 1, where the screw valve has a custom tamper-resistant screw head access and is not flat-head, Phillips-head, Allen wrench, hex wrench, or plier accessible.

12. The fire sprinkler of claim 1, where the shroud is made from impact-resistant material and has a flared end to facilitate guided access to the screw head by a valve closure tool.

13. The fire sprinkler of claim 1, wherein the screw head is painted to facilitate ready identification of closed sprinklers, wherein when the valve is closed and the screw head recessed, the presence or absence of paint can easily be seen.

14. The fire sprinkler of claim 1, where the paint on the screw head is fluorescent and reflective red.

* * * * *